US010260792B1

(12) United States Patent
Frank

(10) Patent No.: US 10,260,792 B1
(45) Date of Patent: Apr. 16, 2019

(54) DRY ICE BAG FOR USE WITH A COOLER

(71) Applicant: Andrew Kyle Frank, Washington, DC (US)

(72) Inventor: Andrew Kyle Frank, Washington, DC (US)

( * ) Notice: Subject to any disclaimer, the term of this patent is extended or adjusted under 35 U.S.C. 154(b) by 234 days.

(21) Appl. No.: 15/376,817

(22) Filed: Dec. 13, 2016

(51) Int. Cl.

| | |
|---|---|
| ***F25D 3/14*** | (2006.01) |
| ***F25D 3/08*** | (2006.01) |
| ***B65D 43/16*** | (2006.01) |
| ***B65D 25/14*** | (2006.01) |
| ***B65D 33/24*** | (2006.01) |
| ***B65D 33/25*** | (2006.01) |
| ***F25D 17/04*** | (2006.01) |
| *A45C 11/20* | (2006.01) |
| *F25D 3/12* | (2006.01) |

(52) U.S. Cl.
CPC ..... *F25D 3/08* (2013.01); *B65D 25/14* (2013.01); *B65D 33/24* (2013.01); *B65D 33/2508* (2013.01); *B65D 43/16* (2013.01); *F25D 17/045* (2013.01); *A45C 11/20* (2013.01); *F25D 3/125* (2013.01); *F25D 3/14* (2013.01); *F25D 2303/082* (2013.01); *F25D 2303/0844* (2013.01); *F25D 2303/08221* (2013.01); *F25D 2303/08222* (2013.01)

(58) Field of Classification Search
CPC ..... A45C 11/20; F25D 3/125; F25D 3/14
See application file for complete search history.

(56) References Cited

U.S. PATENT DOCUMENTS

| | | | | |
|---|---|---|---|---|
| 149,429 | A * | 4/1874 | Booth | A45C 11/20 206/541 |
| 255,420 | A * | 3/1882 | Cunningham | A45C 11/20 206/542 |
| 788,735 | A * | 5/1905 | Stephan | A45C 11/20 206/499 |
| 1,653,913 | A * | 12/1927 | Korwan | A45C 11/20 206/544 |
| 2,563,933 | A * | 8/1951 | Hipps | A61F 7/103 190/903 |
| 3,855,816 | A | 12/1974 | Miller | |
| 4,195,491 | A | 4/1980 | Roncaglione | |
| 4,288,996 | A | 9/1981 | Roncaglione | |
| 6,212,901 | B1 * | 4/2001 | Pint | B65D 81/382 62/265 |
| 7,013,670 | B2 | 3/2006 | Gonzalez | |
| 7,975,504 | B2 | 7/2011 | Whewell, Jr. | |
| 2003/0150767 | A1 * | 8/2003 | Dege | A45C 11/20 206/545 |
| 2004/0035143 | A1 * | 2/2004 | Mogil | A45C 7/0077 62/457.2 |
| 2005/0035120 | A1 * | 2/2005 | Hull | A45C 11/20 220/23.87 |

(Continued)

*Primary Examiner* — Ljiljana V. Ciric
*Assistant Examiner* — Alexis K Cox

(57) ABSTRACT

The dry ice bag for use with a cooler is a device that receives a piece of dry ice, and which is placed inside of a cooler in order to cool said cooler. The dry ice bag includes a mesh opening along a bottom surface that is selectively exposed via a flap member in order to regulate the amount of cold that escapes from the dry ice bag. The dry ice bag also includes a securing member on a top surface such that the entire device is suspended from underneath a top surface of the cooler thereby enabling cold air to descend.

9 Claims, 4 Drawing Sheets

(56) References Cited

U.S. PATENT DOCUMENTS

| | | | | |
|---|---|---|---|---|
| 2005/0037113 | A1* | 2/2005 | Archie, Jr. ..... | A45C 11/20<br>426/109 |
| 2005/0109776 | A1* | 5/2005 | Camp, Jr. ..... | A45C 11/20<br>220/23.86 |
| 2006/0218963 | A1 | 10/2006 | Elias | |
| 2007/0157657 | A1* | 7/2007 | Fogerty ..... | A45C 11/20<br>62/457.2 |

* cited by examiner

DRY ICE BAG FOR USE WITH A COOLER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of accessories for coolers, more specifically, a dry ice bag that is adapted for use within a cooler in order to maintain a cool temperature within said cooler.

SUMMARY OF INVENTION

The dry ice bag for use with a cooler is a device that is adapted to receive a piece of dry ice, and which is adapted to be placed inside of a cooler in order to cool said cooler. The dry ice bag includes a mesh opening along a bottom surface that is selectively exposed via a flap member in order to regulate the amount of cold that escapes from the dry ice bag. The dry ice bag also includes a securing member on a top surface such that the entire device is adapted to be suspended from underneath a top surface of the cooler thereby enabling cold air to descend downwardly.

It is an object of the invention to provide a dry ice bag that is able to secure itself underneath a top surface of a cooler so as to dispense cooled air from a block of dry ice contained within said dry ice bag.

It is a further object of the invention for the dry ice bag to include a mesh opening that is at least partially covered via a flap member in order to regulate the flow of cooled air being dispensed from the dry ice bag.

These together with additional objects, features and advantages of the dry ice bag for use with a cooler will be readily apparent to those of ordinary skill in the art upon reading the following detailed description of the presently preferred, but nonetheless illustrative, embodiments when taken in conjunction with the accompanying drawings.

In this respect, before explaining the current embodiments of the dry ice bag for use with a cooler in detail, it is to be understood that the dry ice bag for use with a cooler is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the dry ice bag for use with a cooler.

It is therefore important that the claims be regarded as including such equivalent construction insofar as they do not depart from the spirit and scope of the dry ice bag for use with a cooler. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
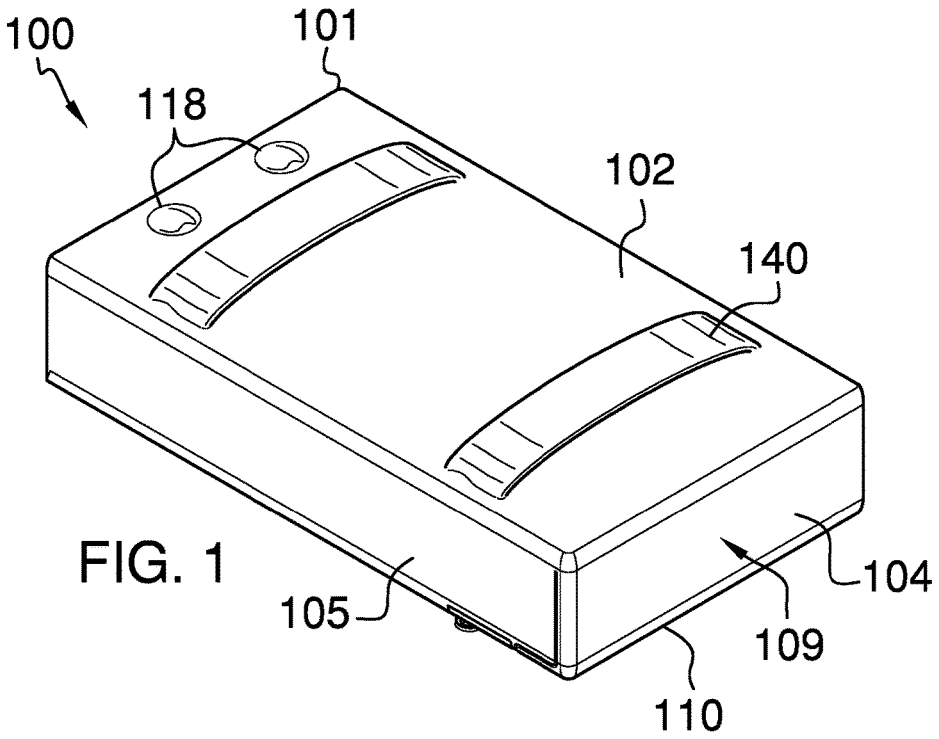
FIG. 1 is a perspective view of an embodiment of the disclosure.
Figure 2:
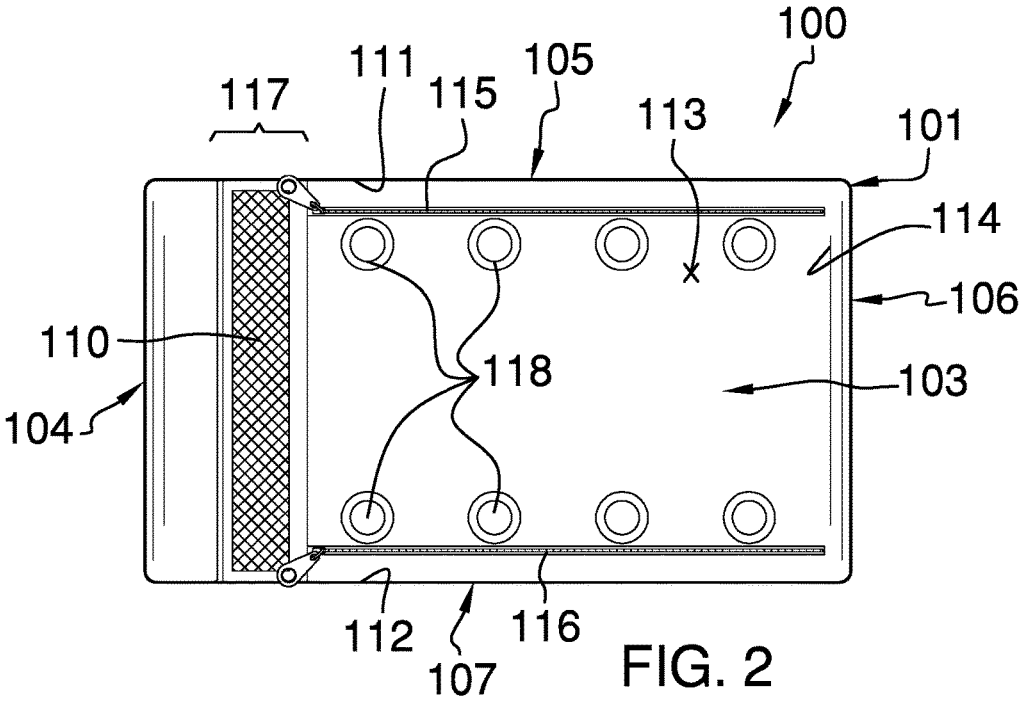
FIG. 2 is a bottom view of an embodiment of the disclosure.
Figure 3:
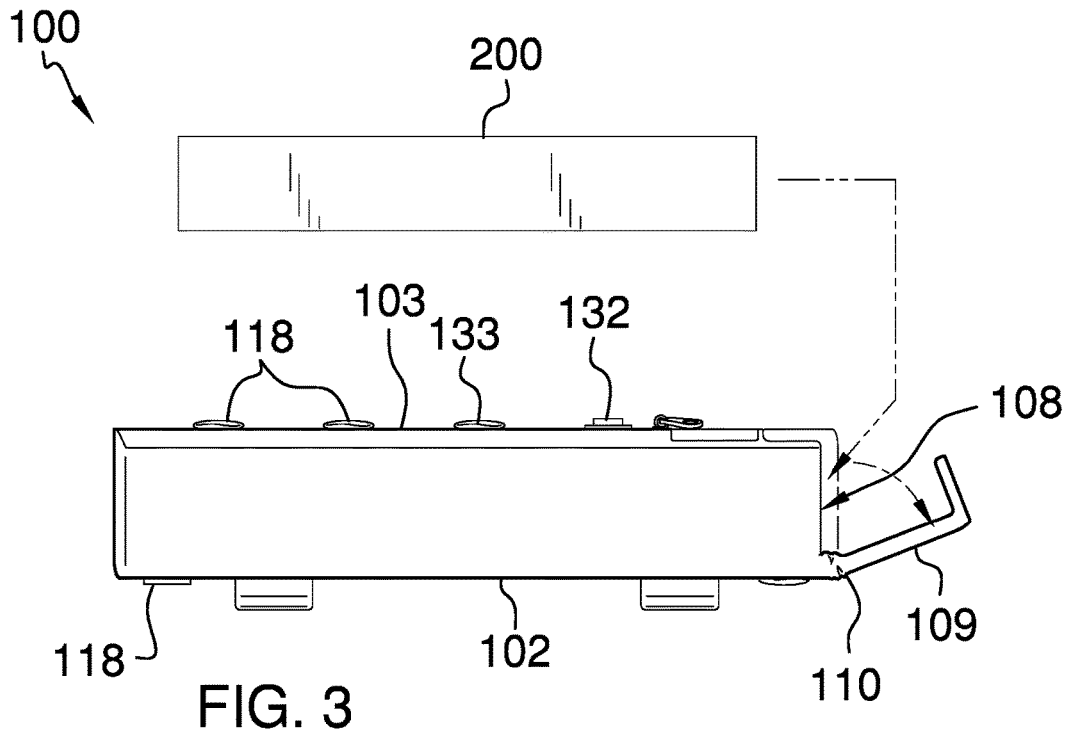
FIG. 3 is a side view of an embodiment of the disclosure.
Figure 4:
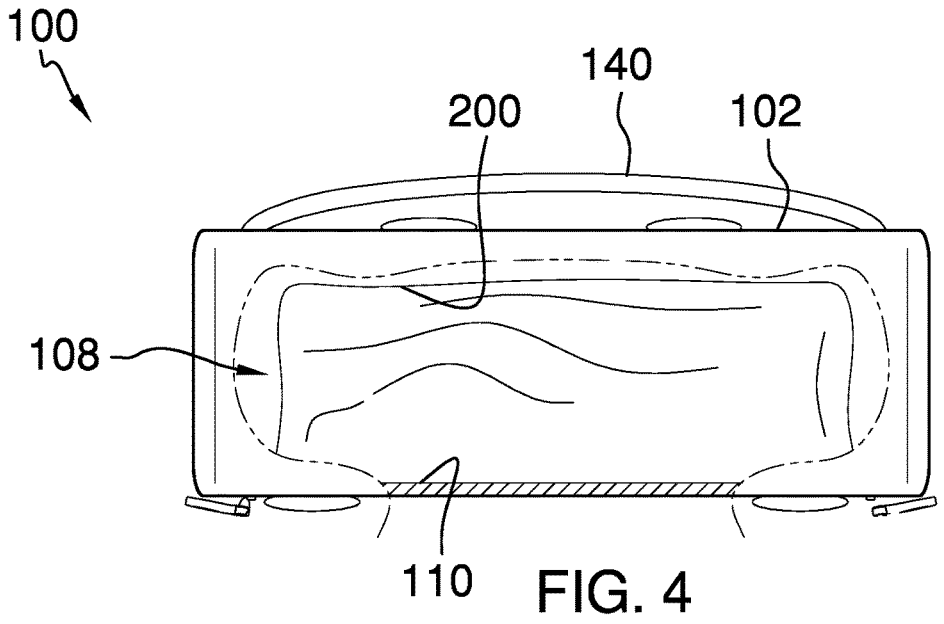
FIG. 4 is an end view of an embodiment of the disclosure.
Figure 5:
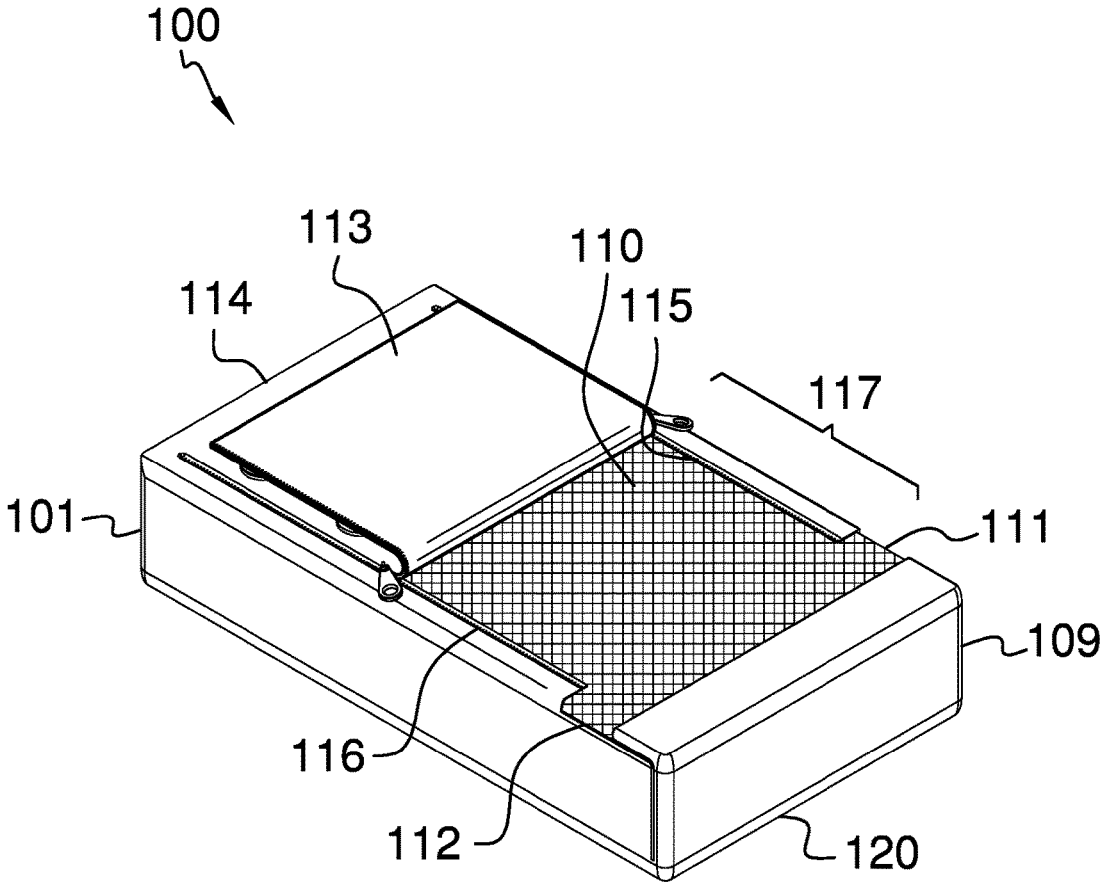
FIG. 5 is a perspective detail view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 4.

The dry ice bag for use with a cooler 100 (hereinafter invention) comprises a dry ice bag 101 that is a rectangularly-shaped box, and is further defined with a top surface 102, a bottom surface 103, a first side surface 104, a second side surface 105, a third side surface 106, and a fourth side surface 107.

The dry ice bag 101 is made of a flexible material such as a fabric. Moreover, the dry ice bag 101 is of hollowed construction so as to provide an interior 108 into which a piece of dry ice 200 may be inserted. The overall function of the invention 100 revolves around supporting the piece of dry ice 200. The interior 108 of the dry ice bag 101 is accessible via an access door 109 that is provided on the first side surface 104. The access door 109 is affixed to a first, bottom edge 120 that is located between the first side surface 104 and the bottom surface 103. The access door 109 is able to rotate outwardly in order to expose the interior 108. Conversely, the access door 109 is able to fold closed in order to seal off the interior 108.

The bottom surface 103 of the dry ice bag 101 is unique in that a mesh member 110 is provided and extends across a first edge 111 and a second edge 112. The bottom surface 103 includes a flap member 113 that is affixed to a third edge 114. The flap member 113 extends between a first zipper member 115 and a second zipper member 116.

Figure 6:
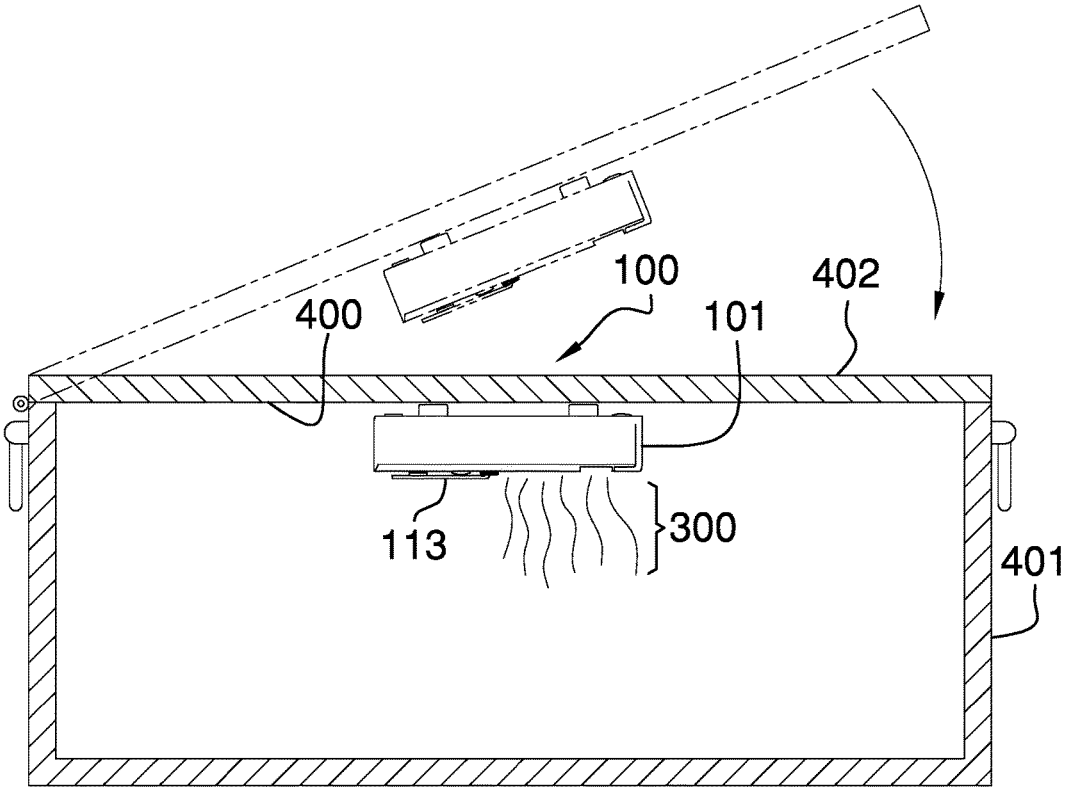
FIG. 6 is side view of an embodiment of the disclosure in use.

The flap member 113 is able to fold backwardly and secure to itself via a plurality of fastener members 118. Moreover, the flap member 113 is able to fold backwardly and secure to itself in order to provide a variable exposure of the mesh member 110 located thereunder. The mesh member 110 is a netting that is adapted to support the piece of dry ice 200 there above. The flap member 113 folds back in order to provide an adjustment as to an area of exposure 117 of the mesh member 110 thereby regulating an amount of chilled air 300 that descends downwardly from the dry ice bag 101 (see FIG. 6).

The area of exposure 117 is set to adjustment via the flap member 113. Moreover, referring to FIG. 2, the area of exposure 117 is smallest where the flap member 113 is fully extended across the bottom surface 103 via the first zipper member 115 and the second zipper member 116. The plurality of fastener members 118 may include the use of snap buttons. The plurality of fastener members 118 are provided on the flap member 113 as well as on the top surface 102 of the dry ice bag 101. The use of snap buttons as the plurality of fastener members 118 enables the flap member 113 to fold over onto itself or around the third side surface 106 of the dry ice bag 101 in order to adjust the area of exposure 117 of the mesh member 110.

It shall be noted that where the plurality of fastener member 118 involves the use of snap buttons. A socket 131 and a stud 132 are well known in the art of snap buttons. The stud 132 is provided adjacent to a fourth edge 133 of the flap member 113. One or more of the sockets 131 are provided on the flap member 113 as well as on the top surface 102 of the dry ice bag 101.

The top surface 102 of the dry ice bag 101 may include at least one securing member 140 thereon. The securing members 140 may involve the use of a strip of adhesive, nylon hook and loop strips, or simply a strap. The at least one securing member 140 is adapted to support the invention 100 against a surface 400. It shall be noted that the surface 400 is being used to loosely refer to an interior surface of a cooler 401. In referring to FIG. 6, the invention 100 is provided underneath a lid 402 of said cooler 401 in order for the chilled air 300 to descend downwardly, thereby aiding in keeping the cooler 401 cold for prolonged periods of time. Obviously, the size of the area of exposure 117 will dictate the longevity of the piece of dry ice 200 in connection with use within the cooler 401.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A dry ice bag for use with a cooler comprising:

said dry ice bag being adapted to receive a piece of dry ice therein;

wherein said dry ice bag is adapted to be secured to an interior surface of a cooler in order to emit chilled air that aids in keeping said cooler cold for a period of time;

wherein the dry ice bag is rectangularly shaped, and is further defined with a top surface, a bottom surface, a first side surface, a second side surface, a third side surface, and a fourth side surface;

wherein the dry ice bag is made of a flexible material;

wherein the top surface is opposite of the bottom surface; wherein the first side surface, the second side surface, the third side surface, and the fourth side surface are positioned between the top surface and the bottom surface;

wherein the first side surface is positioned between the second side surface and the fourth side surface;

wherein the third side surface is positioned between the second side surface and the fourth side surface;

wherein the dry ice bag is further defined with an interior into which said piece of dry ice is adapted to be inserted;

wherein the interior of the dry ice bag is accessible via an access door that is provided on the first side surface;

wherein the access door is affixed to a first, bottom edge that is located between the first side surface and the bottom surface;

wherein the access door is able to rotate outwardly in order to expose the interior;

wherein the access door is able to fold closed in order to seal off the interior;

wherein the bottom surface of the dry ice bag includes a mesh member that is provided and extends across a first edge and a second edge;

wherein the bottom surface includes a flap member that is affixed to a third edge of the bottom surface, extends between a first zipper member and a second zipper member, and is able to fold and secure itself via a plurality of fastener members in order to provide a variable exposure of the mesh member located thereunder.

2. The dry ice bag for use with a cooler according to claim 1 wherein the mesh member is netting that is adapted to support the piece of dry ice there above; wherein the flap member folds back in order to provide an adjustment as to an area of exposure of the mesh member thereby regulating an amount of chilled air that descends downwardly from the dry ice bag.

3. The dry ice bag for use with a cooler according to claim 2 wherein the area of exposure is set to adjustment via the flap member; wherein the plurality of fastener members are provided on the flap member as well as on the top surface of the dry ice bag.

4. The dry ice bag for use with a cooler according to claim 3 wherein the plurality of fastener members includes a plurality of snap buttons; wherein the plurality of snap buttons enables the flap member to fold over onto itself or around the third side surface of the dry ice bag in order to adjust the area of exposure of the mesh member.

5. The dry ice bag for use with a cooler according to claim 4 wherein the top surface of the dry ice bag includes at least one securing member thereon; wherein the at least one securing member is adapted to support the dry ice bag against said interior surface of said cooler.

6. A dry ice bag for use with a cooler comprising:

said dry ice bag being adapted to receive a piece of dry ice therein;

wherein said dry ice bag is adapted to be secured to an interior surface of a cooler in order to emit chilled air that aids in keeping said cooler cold for a period of time;

wherein the dry ice bag is rectangularly shaped, and is further defined with a top surface, a bottom surface, a first side surface, a second side surface, a third side surface, and a fourth side surface;

wherein the dry ice bag is made of a flexible material; wherein the top surface is opposite of the bottom surface; wherein the first side surface, the second side surface, the third side surface, and the fourth side surface are positioned between the top surface and the bottoms surface; wherein the first side surface is positioned between the second side surface and the fourth side surface; wherein the third side surface is positioned between the second side surface and the fourth side surface;

wherein the dry ice bag is further defined with an interior into which said piece of dry ice is adapted to be inserted;

wherein the interior of the dry ice bag is accessible via an access door that is provided on the first side surface;

wherein the access door is affixed to a first, bottom edge that is located between the first side surface and the bottom surface;

wherein the access door is able to rotate outwardly in order to expose the interior;

wherein the access door is able to fold closed in order to seal off the interior;

wherein the bottom surface of the dry ice bag includes a mesh member that is provided and extends across a first edge and a second edge;

wherein the bottom surface includes a flap member that is affixed to a third edge;

wherein the flap member extends between a first zipper member and a second zipper member.

7. The dry ice bag for use with a cooler according to claim 6 wherein the flap member is able to fold backwardly and secure to itself via a plurality of fastener members; wherein the flap member is able to fold backwardly and secure to itself in order to provide a variable exposure of the mesh member located thereunder.

8. The dry ice bag for use with a cooler according to claim 7 wherein the mesh member is netting that is adapted to support the piece of dry ice there above; wherein the flap member folds back in order to provide an adjustment as to an area of exposure of the mesh member thereby regulating an amount of chilled air that descends downwardly from the dry ice bag.

9. The dry ice bag for use with a cooler according to claim 8 wherein the area of exposure is set to adjustment via the flap member; wherein the plurality of fastener members are provided on the flap member as well as on the top surface of the dry ice bag; wherein the plurality of fastener members includes a plurality of snap buttons; wherein the plurality of snap buttons enables the flap member to fold over onto itself or around the third side surface of the dry ice bag in order to adjust the area of exposure of the mesh member; wherein the top surface of the dry ice bag includes at least one securing member thereon; wherein the at least one securing member is adapted to support the dry ice bag against said interior surface of said cooler.

* * * * *